US006112836A

United States Patent [19]

Spaar et al.

[11] Patent Number: 6,112,836

[45] Date of Patent: Sep. 5, 2000

[54] ROTARY DRILL BITS EMPLOYING TANDEM GAGE PAD ARRANGEMENT

[75] Inventors: John R. Spaar, Covington, La.; James A. Norris, Sandy, Utah; Christopher C. Beuershausen, Lafayette, La.; Rudolf C. O. Pessier, Houston, Tex.; Michael P. Ohanian, Slidell, La.; Roland Illerhaus, The Woodlands, Tex.; Jeffrey B. Lund, Salt Lake City, Utah; Michael L. Doster, Spring, Tex.

[73] Assignee: Baker Hughes Incorporated, Houston, Tex.

[21] Appl. No.: 08/924,935

[22] Filed: Sep. 8, 1997

[51] Int. Cl.[7] ..... E21B 17/10

[52] U.S. Cl. ..... 175/408; 175/393; 175/406

[58] Field of Search ..... 175/393, 406, 175/408

[56] References Cited

U.S. PATENT DOCUMENTS

| | | | |
|---|---|---|---|
| 2,553,701 | 5/1951 | Comstock . | |
| 3,318,400 | 5/1967 | Hildebrandt . | |
| 3,322,218 | 5/1967 | Hildebrandt . | |
| 3,367,430 | 2/1968 | Rowley . | |
| 3,575,247 | 4/1971 | Feenstra . | |
| 3,628,616 | 12/1971 | Neilson | 175/408 X |
| 3,820,611 | 6/1974 | King . | |
| 3,825,083 | 7/1974 | Flarity et al. . | |
| 3,871,488 | 3/1975 | Sabre . | |
| 3,978,933 | 9/1976 | Olson et al. . | |
| 4,073,354 | 2/1978 | Rowley et al. . | |
| 4,221,270 | 9/1980 | Vezirian . | |
| 4,244,432 | 1/1981 | Rowley et al. . | |
| 4,246,977 | 1/1981 | Allen . | |
| 4,385,669 | 5/1983 | Knutsen . | |
| 4,429,755 | 2/1984 | Williamson | 175/393 X |
| 4,545,441 | 10/1985 | Williamson . | |
| 4,602,691 | 7/1986 | Weaver . | |
| 4,673,044 | 6/1987 | Bigelow et al. . | |
| 4,676,324 | 6/1987 | Barr et al. | 175/393 |
| 4,714,120 | 12/1987 | King . | |
| 4,869,330 | 9/1989 | Tibbitts . | |
| 4,941,538 | 7/1990 | King . | |
| 5,004,057 | 4/1991 | Tibbits et al. . | |
| 5,033,559 | 7/1991 | Fischer . | |
| 5,033,560 | 7/1991 | Sawyer et al. . | |
| 5,163,524 | 11/1992 | Newton, Jr. et al. . | |
| 5,415,243 | 5/1995 | Lyon et al. . | |
| 5,467,836 | 11/1995 | Grimes et al. . | |
| 5,558,170 | 9/1996 | Thigpen et al. . | |
| 5,601,151 | 2/1997 | Warren . | |
| 5,651,421 | 7/1997 | Newton et al. | 175/408 X |
| 5,655,612 | 8/1997 | Grimes et al. . | |

FOREIGN PATENT DOCUMENTS

| | | |
|---|---|---|
| 0467580 A1 | 7/1991 | European Pat. Off. . |
| 0522553 A1 | 7/1991 | European Pat. Off. . |
| 2294071 | 4/1996 | United Kingdom . |

*Primary Examiner*—Eileen Dunn Lillis
*Assistant Examiner*—Jong-Suk Lee
*Attorney, Agent, or Firm*—Trask, Britt & Rossa

[57] ABSTRACT

A rotary drag bit being suitable for directional drilling. The bit includes a bit body from which extend radially-oriented blades carrying PDC cutters. The blades extend to primary gage pads, above which secondary gage pads are either longitudinally spaced or rotationally spaced, or both, defining a gap or discontinuity between the primary and secondary gage pads through which drilling fluid from adjacent junk slots may communicate laterally or circumferentially. Longitudinally leading edges of the secondary gage pads may carry cutters for smoothing the sidewall of the borehole. The tandem primary and secondary gage pads provide enhanced bit stability and reduced side cutting tendencies. The discontinuities between the primary and secondary gage pads enhance fluid flow from the bit face to the borehole annulus above the bit, promoting formation cuttings removal. The tandem gage arrangement also has utility in conventional bits not designed specifically for directional drilling.

26 Claims, 6 Drawing Sheets

ROTARY DRILL BITS EMPLOYING TANDEM GAGE PAD ARRANGEMENT

BACKGROUND OF THE INVENTION

1. Field of the Invention

The present invention relates generally to rotary bits for drilling subterranean formations. More specifically, the invention relates to fixed cutter, or so-called "drag" bits, wherein tandem gage pads are employed to provide enhanced stability of the bit while drilling both linear and non-linear borehole segments, and leading surfaces of the trailing or secondary gage pads in the tandem arrangement may be provided with cutters to remove ledging on the borehole sidewall.

2. State of the Art

It has long been known to design the path of a subterranean borehole to be other than linear in one or more segments, and so-called "directional" drilling has been practiced for many decades. Variations of directional drilling include drilling of a horizontal or highly deviated borehole from a primary, substantially vertical borehole, and drilling of a borehole so as to extend along the plane of a hydrocarbon-producing formation for an extended interval, rather than merely transversely penetrating its relatively small width or depth. Directional drilling, that is to say varying the path of a borehole from a first direction to a second, may be carried out along a relatively small radius of curvature as short as five to six meters, or over a radius of curvature of many hundreds of meters.

Perhaps the most sophisticated evolution of directional drilling is the practice of so-called navigational or steerable drilling, wherein a drill bit is literally steered to drill one or more linear and non-linear borehole segments as it progresses using the same bottomhole assembly and without tripping the drill string.

Positive displacement (Moineau) type motors as well as turbines have been employed in combination with deflection devices such as bent housings, bent subs, eccentric stabilizers, and combinations thereof to effect oriented, nonlinear drilling when the bit is rotated only by the motor drive shaft, and linear drilling when the bit is rotated by the superimposed rotation of the motor shaft and the drill string.

Other steerable bottomhole assemblies are known, including those wherein deflection or orientation of the drill string may be altered by selective lateral extension and retraction of one or more contact pads or members against the borehole wall. One such system is the AutoTrak™ system, developed by the INTEQ operating unit of Baker Hughes Incorporated, assignee of the present invention. The bottomhole assembly of the AutoTrak™ system employs a non-rotating sleeve through which a rotating drive shaft extends to drive a rotary bit, the sleeve thus being decoupled from drill string rotation. The sleeve carries individually controllable, expandable, circumferentially spaced steering ribs on its exterior, the lateral forces exerted by the ribs on the sleeve being controlled by pistons operated by hydraulic fluid contained within a reservoir located within the sleeve. Closed loop electronics measure the relative position of the sleeve and substantially continuously adjust the position of each steering rib so as to provide a steady side force at the bit in a desired direction.

In any case, those skilled in the art have designed rotary bits, and specifically rotary drag, or fixed cutter bits, to facilitate and enhance "steerable" characteristics of bits, as opposed to conventional bit designs wherein departure from a straight, intended path, commonly termed "walk", is to be avoided. Examples of steerable bit designs are disclosed and claimed in U.S. Pat. 5,004,057 to Tibbitts, assigned to the assignee of the present invention.

Prevailing opinion for an extended period of time has been that bits employing relatively short gages, in some instances even shorter than gage lengths for conventional bits not intended for steerable applications, facilitate directional drilling. The inventors herein have recently determined that such an approach is erroneous, and that short-gage bits also produce an increased amount of borehole irregularities, such as sidewall ledging, spiraling of the borehole, and rifling of the borehole sidewall. Excessive side cutting tendencies of a bit may lead to ledging of a severity such that downhole tools may actually become stuck when traveling through the borehole.

Elongated gage pads exhibiting little or no side cutting aggressiveness, or the tendency to engage and cut the formation, may be beneficial for directional or steerable bits, since they would tend to prevent sudden, large, lateral displacements of the bit, which displacements may result in the aforementioned so-called "ledging" of the borehole wall. However, a simplistic elongated gage pad design approach exhibits shortcomings, as continuous, elongated gage pads extending down the side of the bit body may result in the trapping of formation cuttings in the elongated junk slots defined at the gage of the bit between adjacent gage pads, particularly if a given junk slot is provided with less than optimum hydraulic flow from its associated fluid passage on the face of the bit. Such clogging of only a single junk slot of a bit has been demonstrated to cause premature bit balling in soft, plastic formations. Moreover, providing lateral stabilization for the bit only at the circumferentially-spaced locations of gage pads comprising extensions of blades on the bit face may not be satisfactory in all circumstances. Finally, enhanced stabilization using elongated gage pads may not necessarily preclude all ledging of the borehole sidewall.

Thus, there is a need for a drill bit which provides good directional stability as well as steerability, precludes lateral bit displacement, enhances formation cuttings removal from the bit, and maintains borehole quality.

BRIEF SUMMARY OF THE INVENTION

The present invention comprises a rotary drag bit, preferably equipped with polycrystalline diamond compact (PDC) cutters on blades extending above and radially to the side beyond the bit face, wherein the bit includes tandem, non-aggressive gage pads in the form of primary or longitudinally leading gage pads which may be substantially contiguous with the blades, and secondary or longitudinally trailing gage pads which are at least either longitudinally or rotationally discontinuous with the primary gage pads. Such an arrangement reduces any tendency toward undesirable side cutting by the bit, reducing ledging of the borehole sidewall.

The discontinuous tandem gage pads of the present invention provide the aforementioned benefits associated with conventional elongated gage pads, but provide a gap or aperture between circumferentially adjacent junk slots in the case of longitudinally discontinuous pads so that hydraulic flow may be shared between laterally-adjacent junk slots.

In the case of rotationally-offset secondary gage pads, there is provided a set of rotationally-offset, secondary junk slots above (as the bit is oriented during drilling) the primary junk slots, each of which secondary junk slots communicates with two circumferentially adjacent primary junk slots extending from the bit face, the hydraulic and cuttings flow from each primary junk slot being divided between two secondary junk slots. Thus, a relatively low-flow junk slot is not completely isolated, and excess or greater flows in its two laterally-adjacent junk slots may be contributed in a balancing effect, thus alleviating a tendency toward clogging of any particular junk slot.

In yet another aspect of the invention, the use of circumferentially-spaced, secondary gage pads rotationally offset from the primary gage pads provides superior bit stabilization by providing lateral support for the bit at twice as many circumferential locations as if only elongated primary gage pads or circumferentially-aligned primary and secondary gage pads were employed. Thus, bit stability is enhanced during both linear and non-linear drilling, and any tendency toward undesirable side cutting by the bit is reduced. Moreover, each primary junk slot communicates with two secondary junk slots, promoting fluid flow away from the bit face and reducing any clogging tendency.

In still another aspect of the invention, the secondary gage pads employed in the inventive bit are equipped with cutters on their longitudinally leading edges or surfaces at locations extending radially outwardly only substantially to the radially outer bearing surfaces of the secondary gage pads. Such cutters may also lie longitudinally above the leading edges or surfaces of a pad, but again do not extend beyond the radially outer bearing surface. Such cutters may comprise natural diamonds, thermally stable PDCs, or conventional PDCs comprised of a diamond table supported on a tungsten carbide substrate. The presence of the secondary gage pad cutters provides a reaming capability to the bit so that borehole sidewall irregularities created as the bit drills ahead are smoothed by the passage of the secondary gage pads. Thus, any minor ledging created as a result of bit lateral vibrations or by frequent flexing of the bottomhole assembly driving the bit due to inconsistent application of weight on bit can be removed, improving borehole quality.

Using the tandem gage according to the present invention, a better quality borehole and borehole wall surface in terms of roundness, longitudinal continuity and smoothness is created. Such borehole conditions allow for smoother transfer of weight from the surface of the earth through the drill string to the bit, as well as better tool face control, which is critical for monitoring and following a design borehole path by the actual borehole as drilled.

DETAILED DESCRIPTION OF THE INVENTION

Figure 1:
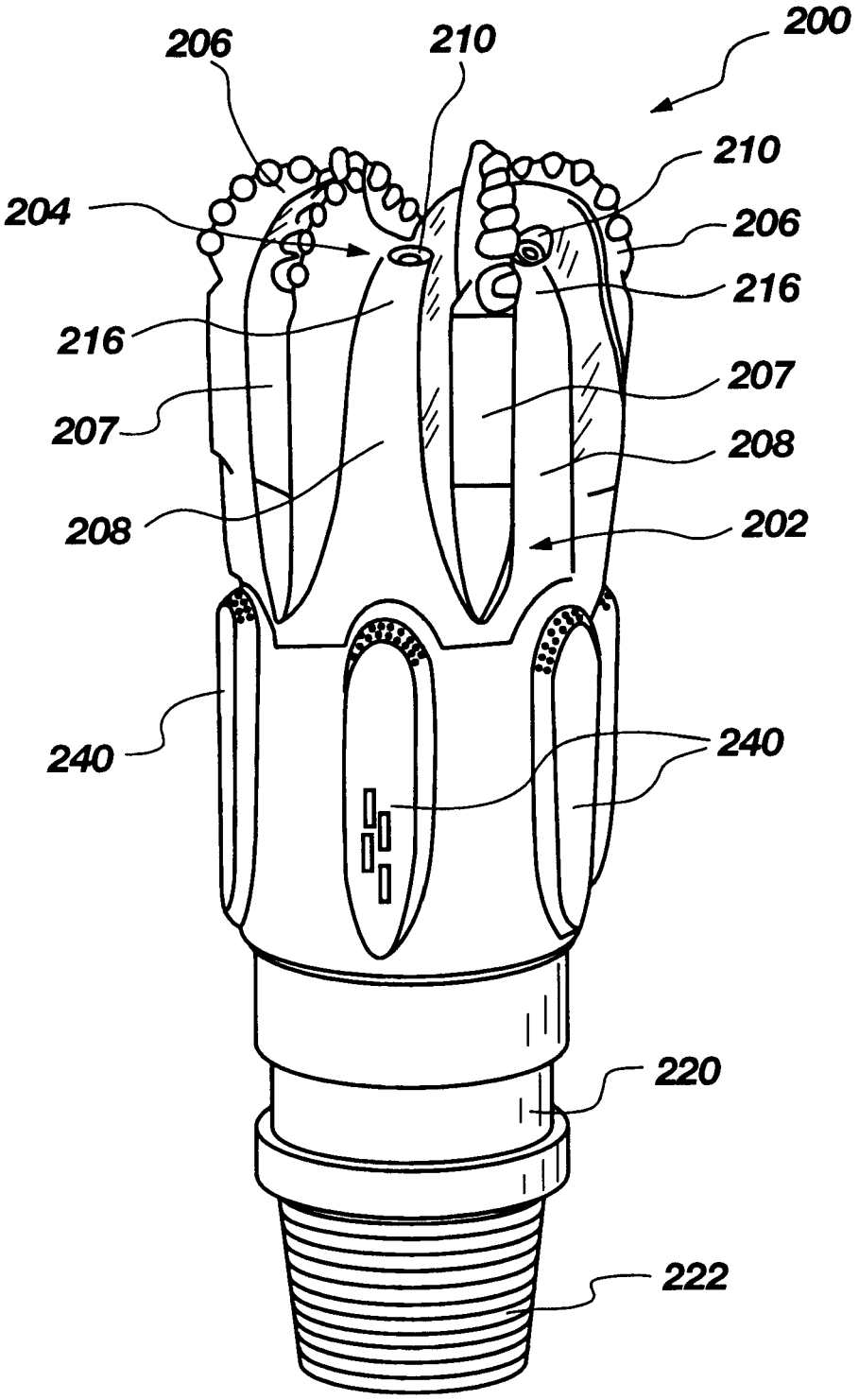
FIG. 1 comprises a side perspective view of a PDC-equipped rotary drag bit according to the present invention.
Figure 2:
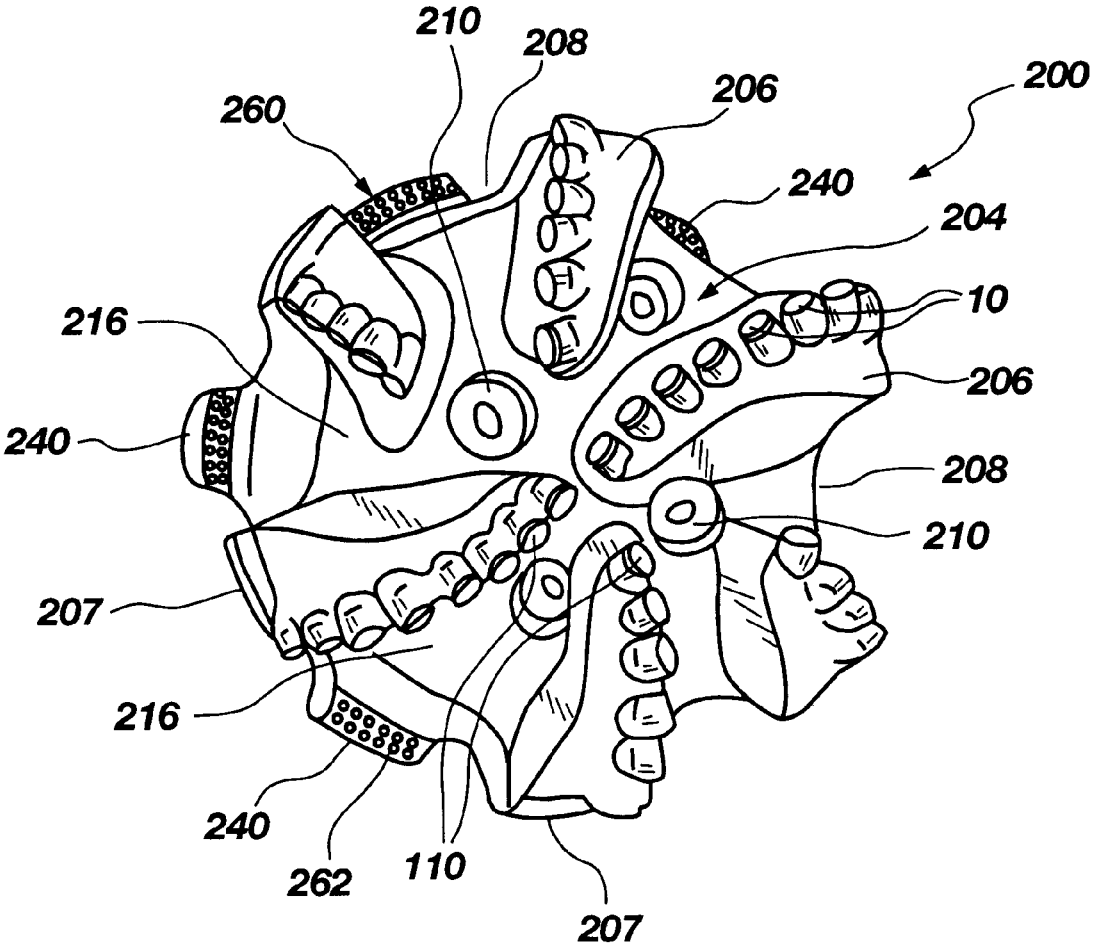
FIG. 2 comprises a face view of the bit of FIG. 1.
Figure 3:
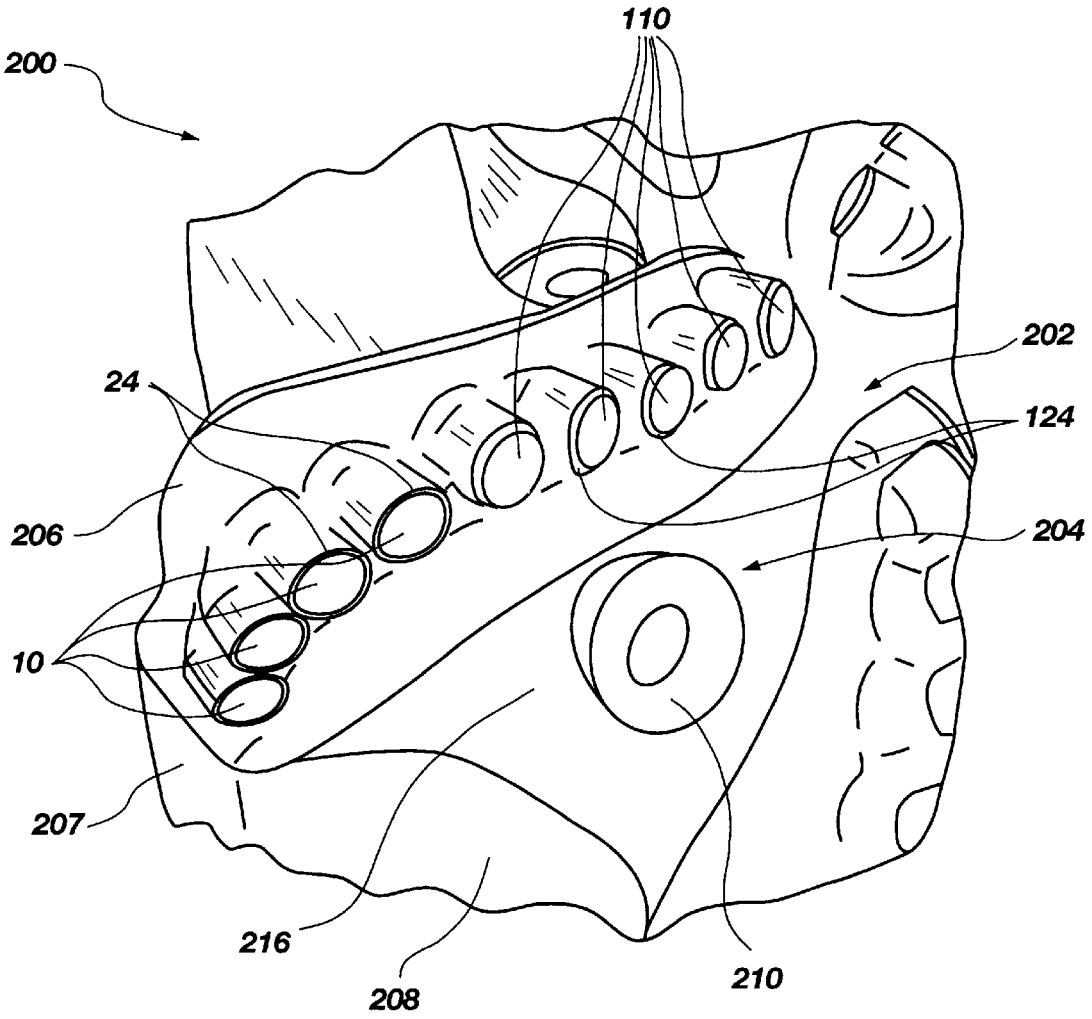
FIG. 3 comprises an enlarged, oblique face view of a single blade of the bit of FIG. 1.

FIGS. 1 through 5 depict an exemplary rotary drag bit 200 according to the invention. Bit 200 includes a body 202 having a face 204 and including a plurality (in this instance, six) of generally radially oriented blades 206 extending above the bit face 204 to primary gage pads 207. Primary junk 208 lie between longitudinal extensions of adjacent blades 206, which comprise primary gage pads 207 in the illustrated embodiment. A plurality of nozzles 210 provide drilling fluid from plenum 212 within the bit body 202 and received through passages 214 to the bit face 204. Formation cuttings generated during a drilling operation are transported across bit face 204 through fluid courses 216 communicating with respective primary junk slots 208. Secondary gage pads 240 are rotationally and substantially longitudinally offset from primary gage pads 207, and provide additional stability for bit 200 when drilling both linear and non-linear borehole segments. Shank 220 includes a threaded pin connection 222 as known in the art, although other connection types may be employed.

Figure 4:
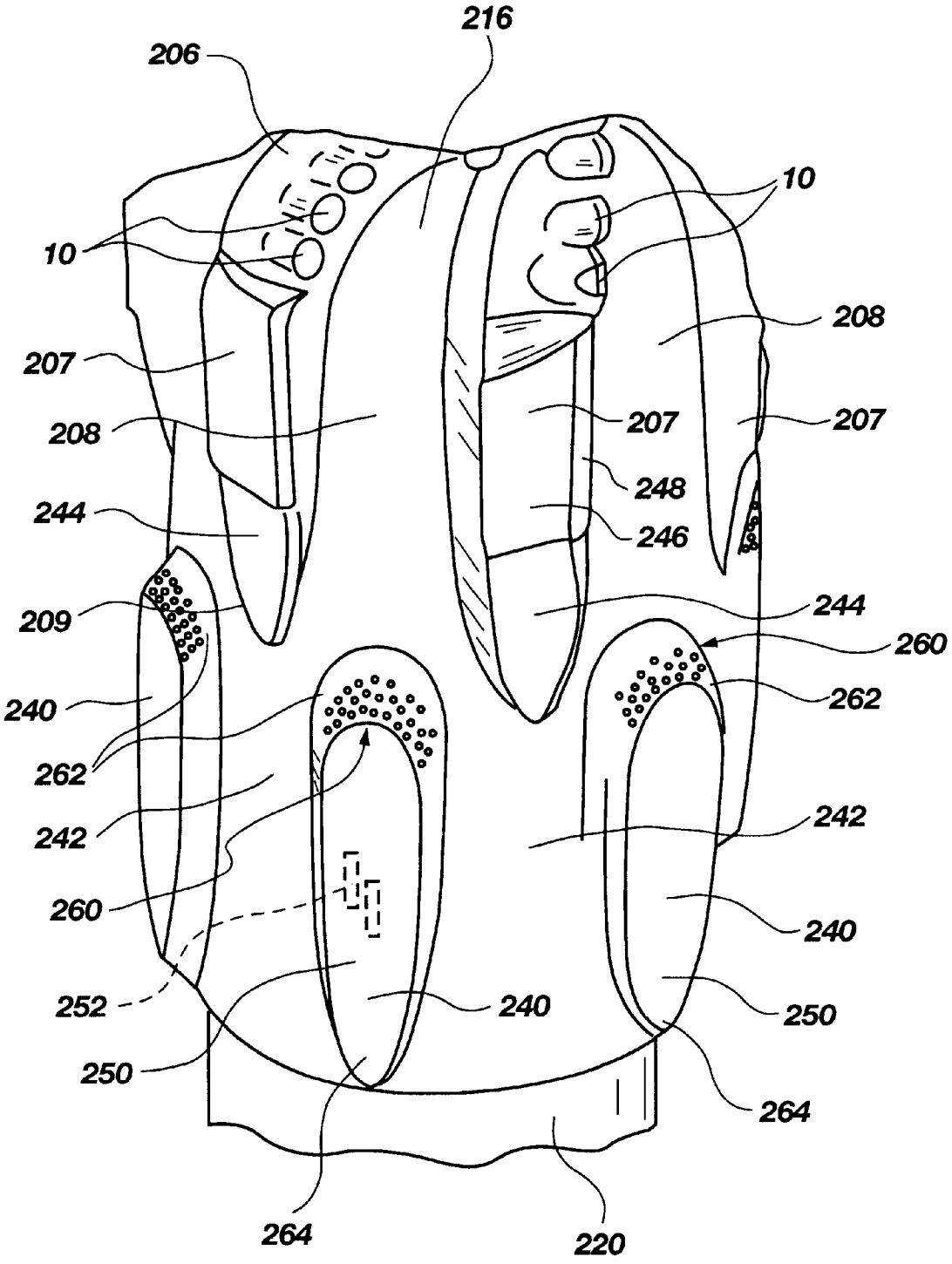
FIG. 4 is an enlarged perspective view of the side of the bit of FIG. 1, showing the configurations and relative locations and orientations of tandem primary gage pads (blade extensions) and secondary gage pads according to the invention.

Primary gage pads 207 define primary junk slots 208 therebetween, while secondary gage pads 240 define secondary junk slots 242 therebetween, each primary junk slot 208 feeding two secondary junk slots 242 with formation cuttings-laden drilling fluid received from fluid courses 216 on the bit face. As shown, the trailing, radially outer surfaces 244 of primary gage pads 207 are scalloped or recessed to some extent, the major, radially outer bearing surfaces 246 of the primary gage pads 207 are devoid of exposed cutters and the rotationally leading edges 248 thereof are rounded or smoothed to substantially eliminate any side cutting tendencies above (in normal drilling orientation) radially outermost cutters 10 on blades 206. Similarly, the radially outer bearing surfaces 250 of secondary gage pads 240 are devoid of exposed cutters for sidecutting, and preferably comprise wear-resistant surfaces such as tungsten carbide, diamond grit-filled tungsten carbide, a ceramic, or other abrasion-resistant material as known in the art. The outer surfaces 250 may also comprise discs, bricks or other inserts of wear-resistant material (see 252 in FIG. 4) bonded to the outer surface of the pads, or bonded into a surrounding powdered WC matrix material with a solidified liquid metal binder, as known in the art. The outer bearing surfaces 246, 250 of respective primary and secondary gage pads 207 and 240 may be rounded at a radius of curvature, taken from the centerline or longitudinal axis of the bit, substantially the same as (slightly smaller than) the gage diameter of the bit, if desired. Further, the secondary gage pads 240 may be sized to define a smaller diameter than the primary gage pads, and measurably smaller than the nominal or gage diameter of the bit 200. As shown in FIGS. 1 and 4, there may be a slight longitudinal overlap between primary gage pads 207 and secondary gage pads 240, although this is not required (see FIG. 6) and the tandem gage pads 207, 240 may be entirely longitudinally discontinuous. It is preferable that the trailing ends 209 of primary gage pads 207 be tapered or streamlined as shown, in order to enhance fluid flow therepast and eliminate areas where hydraulic flow and entrained formation cuttings may stagnate. It is also preferable that secondary gage pads 240 (as shown) be at least somewhat streamlined at both leading edges or surfaces 262 and at their trailing ends 264 for enhancement of fluid flow therepast.

Secondary gage pads 240 carry cutters 260 on their longitudinally leading edges, which in the illustrated embodiment comprise arcuate surfaces 262. As shown, cutters 260 comprise exposed, three-per-carat natural diamonds, although thermally stable PDCs may also be employed in the same manner. The distribution of cutters 260 over arcuate leading surfaces 262 provides both a longitudinal and rotational cutting capability for reaming the sidewall of the borehole after passage of the bit blades 206 and primary gage pads 207 to substantially remove any irregularities in and on the sidewall, such as the aforementioned ledges. Thus, the bottomhole assembly following bit 200 is presented with a smoother, more regular borehole configuration.

Figure 6:
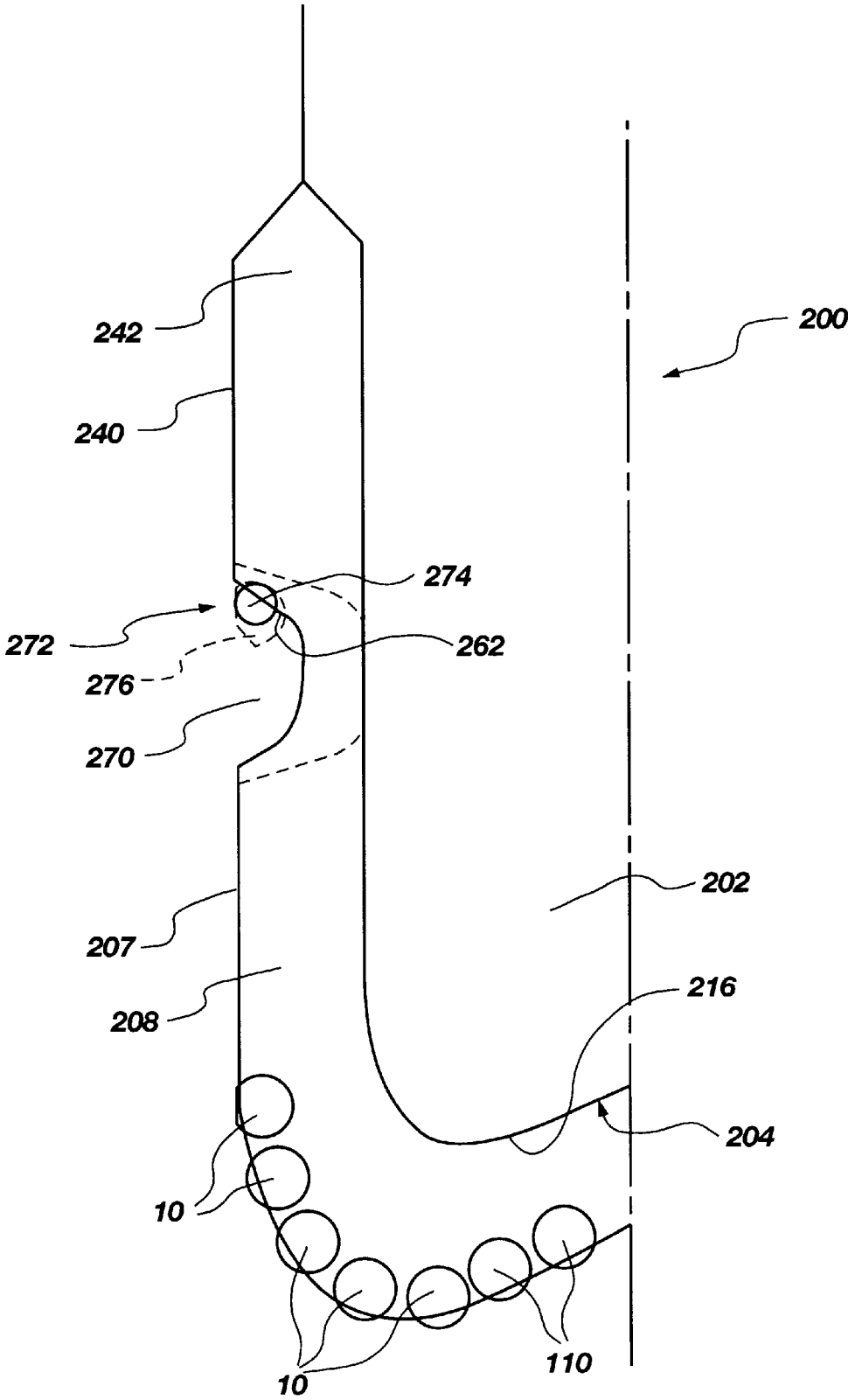
FIG. 6 is a schematic side view of a longitudinally-discontinuous tandem gage pad arrangement according to the invention, depicting the use of PDC cutters on the secondary gage pad leading edge.

As shown in FIG. 6, the bit 200 of the present invention may alternatively comprise circumferentially aligned but longitudinally discontinuous gage pads 207 and 240, with a notch or bottleneck 270 located therebetween. In such a configuration, primary junk slots 208 are rotationally aligned with secondary junk slots 242, and mutual fluid communication between laterally adjacent junk slots (and indeed, about the entire lateral periphery or circumference of bit 200), is through notches or bottlenecks 270. The radial recess depth of notches or bottlenecks 270 may be less than the radial height of the gage pads 207 and 240, or may extend to the bottoms of the junk slots defined between the gage pads, as shown in broken lines. In FIG. 6, the cutters employed on the leading surface 262 of secondary gage pad 240 comprise PDC cutters 272, which may exhibit disc-shaped cutting faces 274, or may be configured with flat or linear cutting edges as shown in broken lines 276. It should also be understood that more than one type of cutter 260 may be employed on a secondary gage pad 240, and that different types of cutters 260 may be employed on different secondary gage pads 240.

Figure 5:
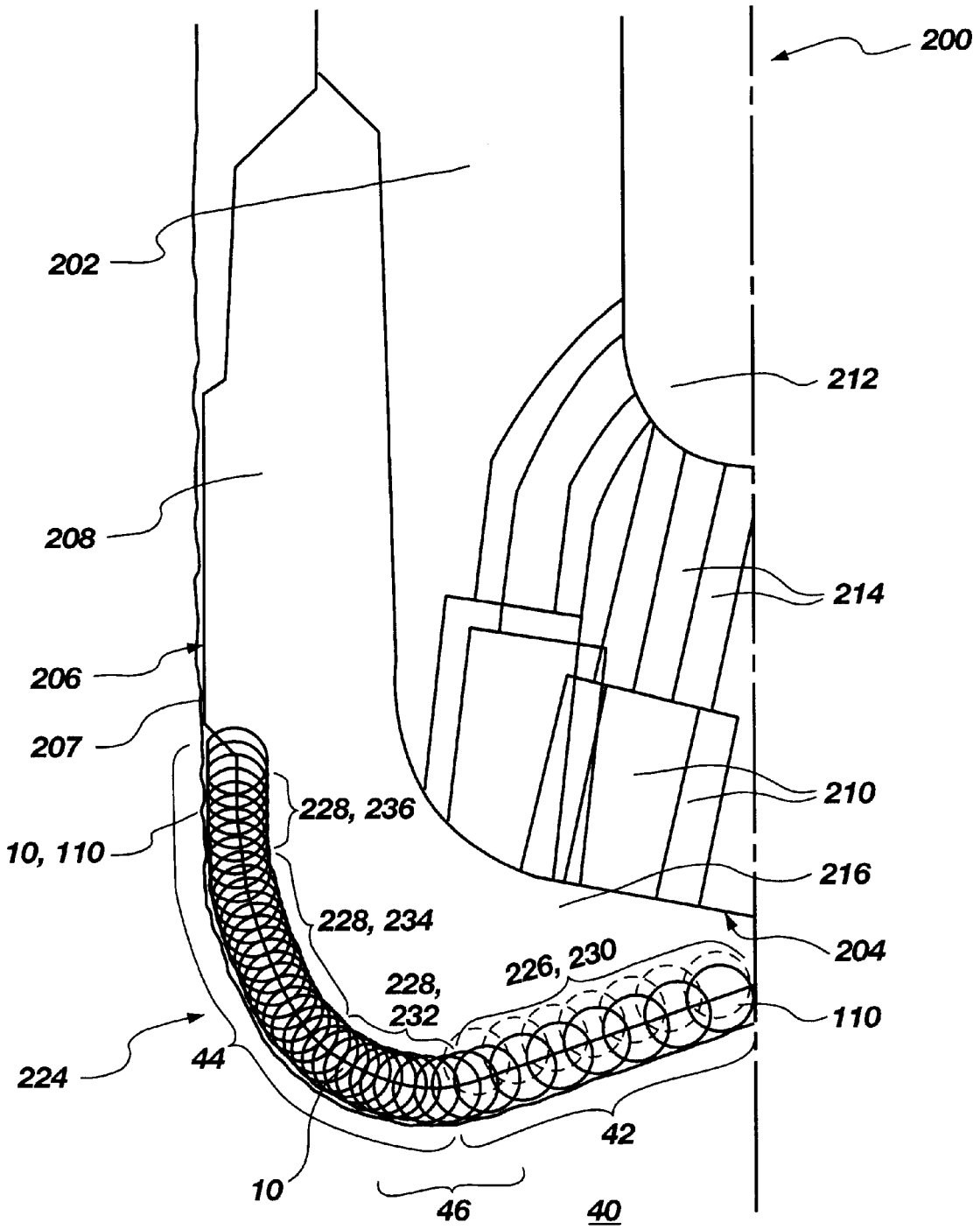
FIG. 5 comprises a quarter-sectional side schematic of a bit having a profile such as that of FIG. 1, with the cutter locations rotated to a single radius extending from the bit centerline to the gage to disclose various cutter chamfer sizes and angles, and cutter backrake angles, which may be employed with the inventive bit.

To complete the description of the bit of FIGS. 1 through 5, although the specific structure is not required to be employed as part of the invention herein, the profile 224 of the bit face 204 as defined by blades 206 is illustrated in FIG. 5, wherein bit 200 is shown adjacent a subterranean rock formation 40 at the bottom of the well bore. Bit 200 is, as disclosed, believed to be particularly suitable for directional drilling, wherein both linear and non-linear borehole segments are drilled by the same bit. First region 226 and second region 228 on profile 224 face adjacent rock zones 42 and 44 of formation 40 and respectively carry large chamfer cutters 110 and small chamfer cutters 10. First region 226 may be said to comprise the cone 230 of the bit profile 224 as illustrated, whereas second region 228 may be said to comprise the nose 232 and flank 234 and extend to shoulder 236 of profile 224, terminating at primary gage pad 207.

In a currently preferred embodiment of the invention, large chamfer cutters 110 may comprise cutters having PDC tables in excess of 0.070 inch thickness, and preferably about 0.080 to 0.090 inch thickness, with chamfers 124 of about a 0.030 to 0.060 inch width, looking at and perpendicular to the cutting face, and oriented at a 45° angle to the cutter axis. The cutters themselves, as disposed in region 226, are backraked at 20° to the bit profile at each respective cutter location, thus providing chamfers 124 with a 65° backrake. Cutters 10, on the other hand, disposed in region 228, may comprise conventionally-chamfered cutters having about a 0.030 inch PDC table thickness, and a 0.010 inch chamfer width looking at and perpendicular to the cutting face, with chamfers 24 oriented at a 45° angle to the cutter axis. Cutters 10 are themselves backraked at 15° on nose 232 (providing a 60° chamfer backrake), while cutter backrake is further reduced to 10° at the flank 234, shoulder 236 and on the primary gage pads 207 of bit 220 (resulting in a 55° chamfer backrake). The PDC cutters 10 on primary gage pads 207 include preformed flats thereon oriented parallel to the longitudinal axis of the bit 200, as known in the art. In steerable applications requiring greater durability at the shoulder 236, large chamfer cutters 110 may optionally be employed, but oriented at a 10° cutter backrake. Further, the chamfer angle of cutters 110 in each of regions 226 and 236 may be other than 45°. For example, 70° chamfer angles may be employed with chamfer widths (looking vertically at the cutting face of the cutter) in the range of about 0.035 to 0.045 inch, cutters 110 being disposed at appropriate backrakes to achieve the desired chamfer rake angles in the respective regions.

A boundary region, rather than a sharp boundary, may exist between first and second regions 226 and 228. For example, rock zone 46 bridging the adjacent edges of rock zones 42 and 44 of formation 46 may comprise an area wherein demands on cutters and the strength of the formation are always in transition due to bit dynamics. Alternatively, the rock zone 46 may initiate the presence of a third region on the bit profile wherein a third size of cutter chamfer is desirable. In any case, the annular area of profile 224 opposing zone 46 may be populated with cutters of both types (i.e., width and chamfer angle) and employing backrakes respectively employed in region 226 and those of region 228, or cutters with chamfer sizes, angles and cutter backrakes intermediate those of the cutters in regions 226 and 228 may be employed.

Further, it will be understood and appreciated by those of ordinary skill in the art that the tandem gage pad configuration of the invention has utility in conventional bits as well as for bits designed specifically for steerability, and is therefore not so limited.

In the rotationally-offset secondary gage pad variation of the invention, it is further believed that the additional contact points afforded between the bit and the formation may reduce the tendency of a bit to incur damage under "whirl", or backward precession about the borehole, such phenomenon being well known in the art. By providing additional, more closely circumferentially-spaced points of lateral contact between the bit and the borehole sidewall, the distance a bit may travel laterally before making contact with the sidewall is reduced, in turn reducing severity of any impact.

While the present invention has been described in light of the illustrated embodiment, those of ordinary skill in the art will understand and appreciate it is not so limited, and many additions, deletions and modifications may be effected to the invention as illustrated without departing from the scope of the invention as hereinafter claimed. For example, primary and secondary gage pads may be straight or curved, and may be oriented at an angle to the longitudinal axis of the bit, so as to define a series of helical segments about the lateral periphery thereof.

What is claimed is:

1. A rotary drag bit for drilling a subterranean formation, comprising:

a bit body having a longitudinal axis and extending radially outward therefrom toward a gage, the bit body including a face to be oriented toward the subterranean formation during drilling and carrying structure for cutting the subterranean formation and defining a borehole diameter therethrough;

a first plurality of circumferentially-spaced gage pads disposed about a periphery of the bit body and extending longitudinally away from the bit face and terminating generally within a first preselected longitudinal distance from the bit face to a preselected point on the periphery of the bit body; and a second plurality of circumferentially-spaced gage pads being substantially devoid of side-cutting structure on radially oriented surfaces thereof, the second plurality of gage pads being disposed about the periphery of the bit body and the second plurality of gage pads generally originating longitudinally proximate side the preselected point and being generally positioned and extending longitudinally away from the bit face a greater longitudinal distance than the first plurality of gage pads and terminating generally within a second preselected longitudinal distance from the bit face, the second plurality of gage pads being discontinuous with the first plurality of gage pads.

2. The rotary drag bit of claim 1, wherein the second plurality of gage pads is longitudinally spaced from the first plurality of gage pads.

3. The rotary drag bit of claim 1, wherein the second plurality of gage pads is rotationally offset from the first plurality of gage pads.

4. The rotary drag bit of claim 3, wherein the second plurality of gage pads originates generally within a third preselected longitudinal distance that is longitudinally spaced beyond the first preselected longitudinal distance of the first plurality of gage pads.

5. The rotary drag bit of claim 1, wherein the first plurality of gage pads in addition to the second plurality of gage pads is substantially devoid of cutting structure on radially oriented surfaces thereof.

6. The rotary drag bit of claim 5, wherein the first plurality of gage pads and the second plurality of gage pads are substantially devoid of cutters on the radially oriented surfaces thereof.

7. The rotary drag bit of claim 1, wherein the structure for cutting comprises a plurality of PDC cutters.

8. The rotary drag bit of claim 7, wherein at least some of the PDC cutters are carried on a plurality of blades extending about and radially outwardly of the bit face.

9. The rotary drag bit of claim 8, wherein the first plurality of gage pads is disposed as longitudinal extensions of the blades.

10. The rotary drag bit of claim 9, wherein the longitudinal extensions are contiguous with the blades.

11. The rotary drag bit of claim 10, wherein distant-most ends of the first plurality of gage pads extending longitudinally away from the bit face are tapered.

12. The rotary drag bit of claim 1, wherein distant-most ends of the first plurality of gage pads extending longitudinally away from the bit face are tapered.

13. The rotary drag bit of claim 12, wherein at least portions of the tapered ends facing radially outward are of reduced radial extent than radially outward surfaces of the first plurality of gage pads longitudinally closer to the bit face.

14. The rotary drag bit of claim 1, wherein at least the ends longitudinally closest to the bit face of the second plurality of gage pads are tapered.

15. The rotary drag bit of claim 14, wherein the tapered ends are rounded.

16. The rotary drag bit of claim 14, wherein distant-most ends of the second plurality of gage pads extending longitudinally away from the bit face are tapered.

17. The rotary drag bit of claim 1, wherein radially outer surfaces of the first and second pluralities of gage pads are comprised at least in part of wear-resistant materials.

18. The rotary drag bit of claim 1, wherein rotationally leading edges of the first and second pluralities of gage pads are rounded.

19. The rotary drag bit of claim 1, wherein the first and second pluralities of gage pads comprise an equal number of pads.

20. The rotary drag bit of claim 1, wherein each of the first and second pluralities of gage pads defines a corresponding plurality of junk slots between laterally adjacent gage pads of the same plurality.

21. The rotary drag bit of claim 20, wherein each junk slot defined by the first plurality of gage pads is substantially rotationally aligned with each junk slot defined by the second plurality of gage pads.

22. The rotary drag bit of claim 20, wherein each junk slot defined by the first plurality of gage pads is substantially rotationally aligned with each gage pad defined by the second plurality of gage pads.

23. The rotary drag bit of claim 20, wherein the first plurality of gage pads is separated from the second plurality of gage pads by a radial recess extending circumferentially about the bit body.

24. The rotary drag bit of claim 23, wherein the recess has a bottom substantially coextensive with junk slot bottoms of at least one of the plurality of junk slots.

25. A rotary drag bit for drilling a subterranean formation, comprising:

a bit body having a longitudinal axis and extending radially outward therefrom toward a gage, the bit body including a face to be oriented toward the subterranean formation during drilling and carrying structure for cutting the subterranean formation and defining a borehole diameter therethrough;

a first plurality of circumferentially-spaced gage pads disposed about a periphery of the bit body and extending longitudinally away from the bit face;

a second plurality of circumferentially-spaced gage pads being substantially devoid of side-cutting structure on radially oriented surfaces thereof, the second plurality of gage pads being disposed about the periphery of the bit body and the second plurality of gage pads being generally positioned and extending longitudinally away from the bit face a greater longitudinal distance than the first plurality of gage pads, the second plurality of gage pads being discontinuous with the first plurality of gage pads;

a radial recess extending circumferentially about the bit body separating the first plurality of gage pads from the second plurality of gage pads; and wherein each of the first and second pluralities of gage pads defines a corresponding plurality of junk slots between laterally adjacent gage pads of the same plurality.

26. The rotary drag bit of claim 25, wherein the recess has a bottom substantially coextensive with junk slot bottoms of at least one of the pluralities of junk slots.

* * * * *

UNITED STATES PATENT AND TRADEMARK OFFICE

CERTIFICATE OF CORRECTION

PATENT NO. : 6,112,836
DATED : September 5, 2000
INVENTOR(S) : Spaar et al.

It is certified that error appears in the above-identified patent and that said Letters Patent is hereby corrected as shown below:

Column 1,
Line 9, after "cutter" delete ",";
Line 26, after "say" insert -- , --;

Column 4,
Line 12, after "junk" insert -- slots --;
Line 14, change "provide" to -- provides --;
Line 43, after "outer" insert -- bearing --.

Column 5,
Line 23, after "200)" delete ",";

Column 6,
Line 2, change "220" to -- 200 --;

Column 6,
Line 9, change "236" to -- 228 --; and
Line 19, change "46" to -- 40 --.

Column 7,
Line 10, delete "side"; and

Column 8,
Line 59, change "pluralities" to -- plurality --.

Signed and Sealed this

Eighteenth Day of June, 2002

*Attest:*

*Attesting Officer*

JAMES E. ROGAN
*Director of the United States Patent and Trademark Office*